US007448846B2

(12) United States Patent
Ruthemeyer et al.

(10) Patent No.: US 7,448,846 B2
(45) Date of Patent: Nov. 11, 2008

(54) THERMALLY COMPLIANT TURBINE SHROUD MOUNTING

(75) Inventors: Michael Anthony Ruthemeyer, Cincinnati, OH (US); Glenn Herbert Nichols, Mason, OH (US); Ching-Pang Lee, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 525 days.

(21) Appl. No.: 11/161,515

(22) Filed: Aug. 6, 2005

(65) Prior Publication Data

US 2007/0031255 A1 Feb. 8, 2007

(51) Int. Cl.
*F01D 11/08* (2006.01)

(52) U.S. Cl. ..... 415/135; 415/173.1

(58) Field of Classification Search ..... 415/134, 415/135, 136, 137, 173.1, 173.3, 174.2, 213.1; 277/647

See application file for complete search history.

(56) References Cited

U.S. PATENT DOCUMENTS 3,860,358 A * 1/1975 Cavicchi et al. ..... 415/173.1
6,354,795 B1 3/2002 White et al.
6,361,273 B1 * 3/2002 Eng et al. ..... 415/173.1

* cited by examiner

*Primary Examiner*—Richard Edgar
(74) *Attorney, Agent, or Firm*—Adams Intellectual Property Law, P.A.; William Scott Andes, Esq.

(57) ABSTRACT

A shroud segment is adapted to surround a row of rotating turbine blades in a gas turbine engine. The shroud segment includes: an arcuate, axially extending first mounting flange having a first radius of curvature, and an arcuate, axially extending first overhang having a second radius of curvature. The overhang is disposed parallel to and radially inboard of the first mounting flange so that a first groove is defined between the first mounting flange and the first overhang. The first and second radii of curvature are substantially different from each other. The shroud segment may attached to a supporting structure or shroud hanger to form a shroud assembly.

8 Claims, 7 Drawing Sheets

THERMALLY COMPLIANT TURBINE SHROUD MOUNTING

BACKGROUND OF THE INVENTION

This invention relates generally to gas turbine components, and more particularly to turbine shrouds and related hardware.

It is desirable to operate a gas turbine engine at high temperatures for efficiently generating and extracting energy from these gases. Certain components of a gas turbine engine, for example stationary shrouds segments and their supporting structures, are exposed to the heated stream of combustion gases. The shroud is constructed to withstand primary gas flow temperatures, but its supporting structures are not and must be protected therefrom. To do so, a positive pressure difference is maintained between the secondary flowpath and the primary flowpath. This is expressed as a back flow margin or "BFM". A positive BFM ensures that any leakage flow will move from the non-flowpath area to the flowpath and not in the other direction.

In prior art turbine designs, various arcuate features such as the above-mentioned shrouds and supporting members are designed to have matching circumferential curvatures at their interfaces under cold (i.e. room temperature) assembly conditions. During hot engine operating conditions, the shrouds and hangers heat up and expand according to their own temperature responses. Because the shroud temperature is much hotter than the supporting structure temperature, the curvature of the shroud segment will expand more and differently from the supporting structure at the interface under steady state, hot temperature operation conditions. In addition, there is more thermal gradient within the shroud than in the supporting structure, resulting in more deflection or cording of the shroud.

Because of these curvature differences between the shroud segment and the supporting structure at the interface, a leakage gap is formed between the shroud segment and the supporting structure and can cause excessive leakage of cooling air, ultimately increasing the risk of localized ingestion of hot flow path gases. These curvature differences also create stresses on the shroud and hanger at the hot temperature condition, lowering the cyclic life of the shroud and hanger. This has led to the use of shroud assemblies which utilize retainers known as "C-clips" to secure the shroud segments to the supporting structure. While the C-clips allow for distortion, they are highly stressed components which present their own problems and can cause serious engine damage if they fail.

Accordingly, there is a need for a shroud design that can reduce the curvature deviation between the a shroud and its supporting structure at hot operating conditions in order to reduce both leakage and stresses at all operating conditions.

BRIEF SUMMARY OF THE INVENTION

The above-mentioned need is met by the present invention, which according to one aspect provides an arcuate shroud segment adapted to surround a row of rotating turbine blades in a gas turbine engine, the shroud segment including: an arcuate, axially extending first mounting flange having a first radius of curvature; an arcuate, axially extending first overhang having a second radius of curvature, the first overhang disposed parallel to and radially inboard of the first mounting flange so that a first groove is defined between the first mounting flange and the first overhang; wherein the first and second radii of curvature are substantially different from each other.

According to another aspect of the invention, a shroud assembly for a gas turbine engine, comprising: a supporting structure having an arcuate, axially-extending first hook with a first radius of curvature; at least one arcuate shroud segment adapted to surround a row of rotating turbine blades, the shroud segment including: an arcuate, axially extending first mounting flange having a second radius of curvature; and an arcuate, axially extending first overhang having a third radius of curvature, the overhang disposed parallel to and radially inboard of the first mounting flange so that the first mounting flange and the first overhang define a first groove therebetween for receiving the first hook. A selected one of the second and third radii of curvature is substantially different from both the other one of the second and third radii of curvature, and the first radius of curvature.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
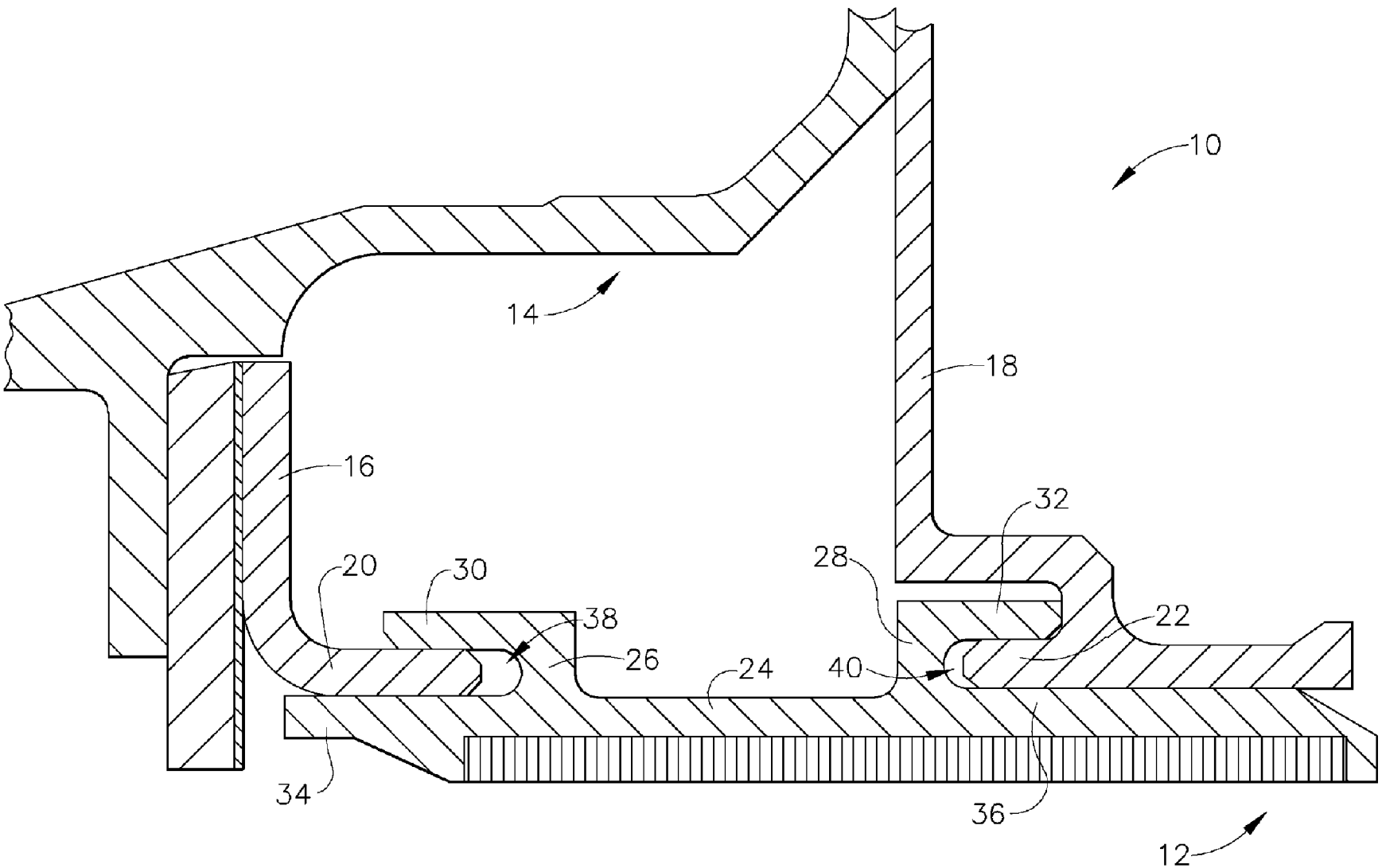
FIG. 1 (PRIOR ART)
FIG. 1 is a cross-sectional view of a portion of a prior art high-pressure turbine shroud assembly.

Referring to the drawings wherein identical reference numerals denote the same elements throughout the various views, FIG. 1 illustrates a portion of a high-pressure turbine (HPT) shroud assembly 10 of a known type comprising a plurality of arcuate shroud segments 12 arranged circumferentially in an annular array so as to closely surround an array of turbine blades (not shown) and thereby define the outer radial flowpath boundary for hot combustion gases. A supporting structure 14 is carried by an engine casing (not shown) and retains the shroud segments 12 to the casing The supporting structure 14 has spaced-apart forward and aft radially-extending arms 16 and 18, respectively. The support structure 14 may be a single continuous 360° component, or it may be segmented into two or more arcuate segments. An arcuate forward hook 20 extends axially aft from the forward arm 16, and an arcuate aft hook 22 extends axially aft from the aft arm 18.

The shroud segment 12 includes an arcuate base 24 with forward and aft rails 26 and 28, carrying forward and aft mounting flanges 30 and 32, respectively. The shroud segment 12 also has forward and aft overhangs 34 and 36 which cooperate with the forward and aft mounting flanges 30 and 32 to define forward and aft grooves 38 and 40, respectively. The forward mounting flange 30 engages the forward hook 20, and the aft mounting flange 32 engages the aft hook 22.

Figure 2:
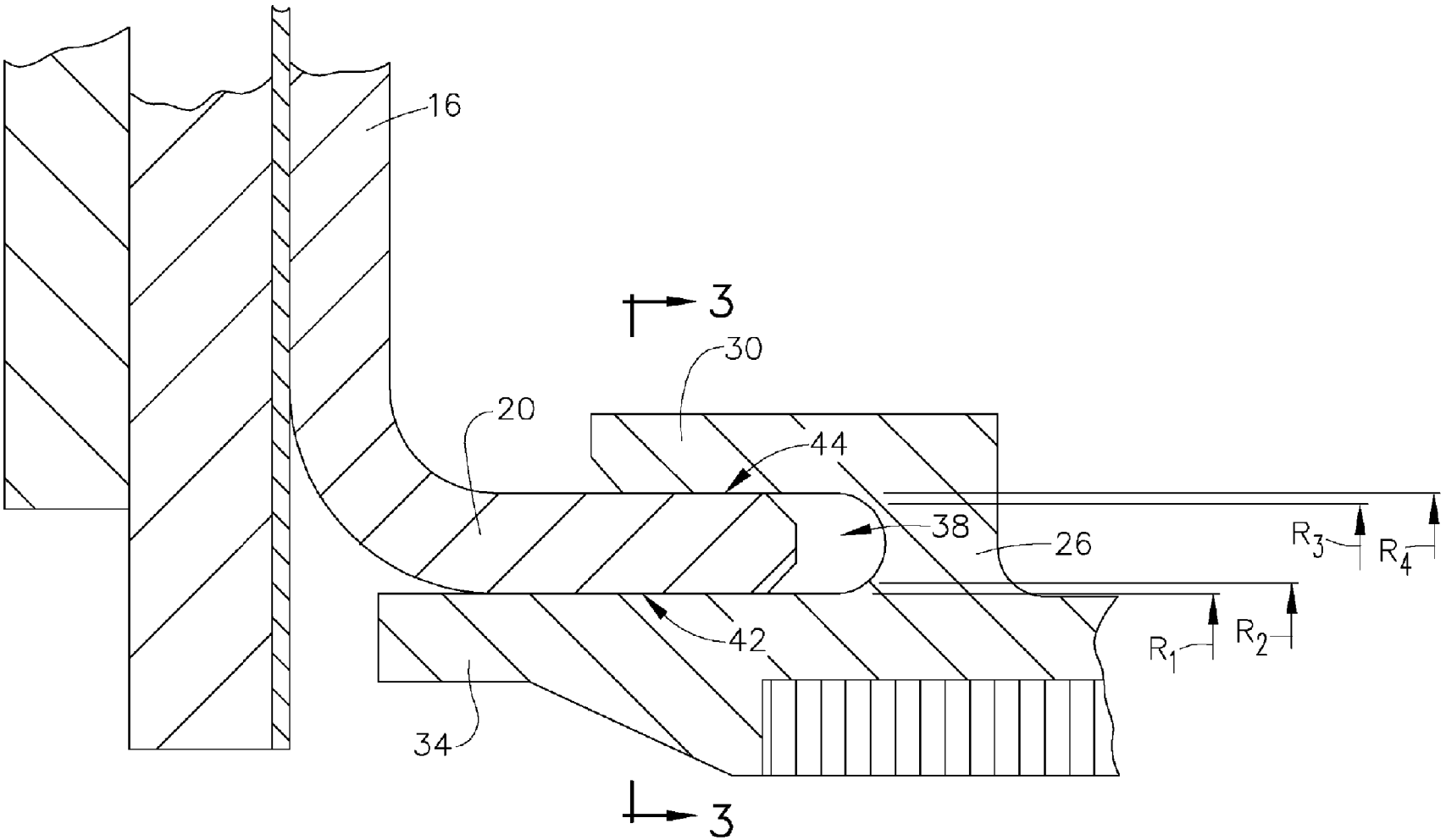
FIG. 2 is an enlarged view of a portion of the shroud assembly of FIG. 1.

FIG. 2 is an enlarged view of the forward portion of the shroud segment 12, showing the radii of various components. "R1" is the outside radius of the forward overhang 34 of the shroud segment 12. "R2" is the inside radius of the forward hook 20 of the supporting structure 14, and "R3" is its outside radius. Finally, "R4" is the inside radius of the forward mounting flange 30 of the shroud segment 12. These radii define interfaces 42 and 44 between the various components. For example, the radii "R1" of the forward overhang 34 and "R2" of the forward hook 20 meet at the interface 42.

Figure 3A:
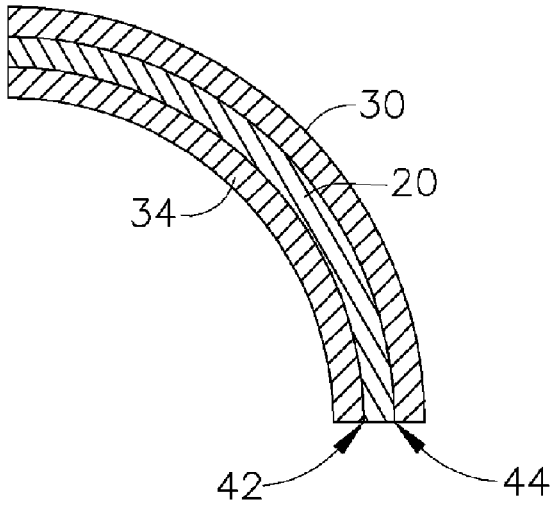
FIG. 3A (PRIOR ART)
FIG. 3A is partial cross-sectional view taken along lines 3-3 of FIG. 2 at a cold assembly condition.

FIG. 3A shows the relationship of the curvatures of these interfaces 42 and 44 at a cold (i.e. room temperature) assembly condition. The curvatures are designed to result in a preselected dimensional relationship at this condition. The term "preselected dimensional relationship" as used herein means that a particular intended relationship between components applies more or less consistently at the interface, whether that relationship be a specified radial gap, a "matched interface" where the gap between components is nominally zero, or a specified amount of radial interference. For example, in FIG. 3A, the interfaces 42 and 44 both "matched interfaces" in that radius R1 is equal to radius R2, and radius R3 is equal to radius R4. It should be noted that the term "curvature" is used to refer to deviation from a straight line, and that the magnitude of curvature is inversely proportional to the circular radius of a component or feature thereof.

Figure 3B:
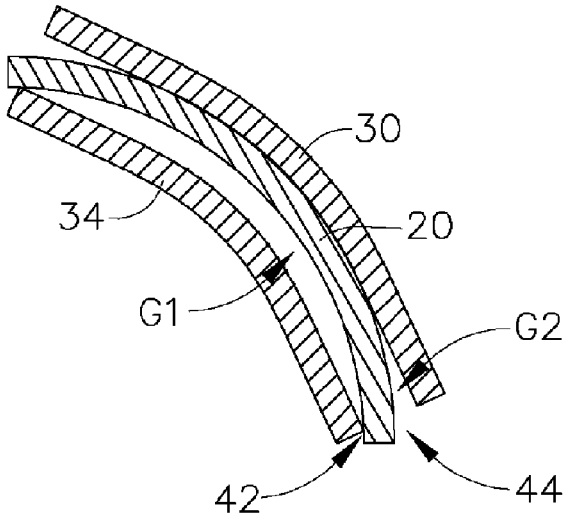
FIG. 3B (PRIOR ART)
FIG. 3B is partial cross-sectional view taken along lines 3-3 of FIG. 2 at a hot operating condition.

FIG. 3B illustrates the changes of the interfaces 42 and 44 from a cold assembly condition to a hot engine operation condition. At operating temperatures, for example bulk material temperatures of about 538° C. (1000° F.) to about 982° C. (1800° F.), the shroud segment 12 and support structure 14 will heat up and expand according to their own temperature responses. Because the shroud temperature is much hotter than the supporting structure temperature, the curvature of the shroud segment 12 will expand more and differently from the supporting structure 14 at the interfaces 42 and 44 under steady state, hot temperature operating conditions. In addition, there is more thermal gradient within the shroud segment 12 than in the supporting structure 14. As a result, the shroud segment 12 and its forward mounting flange 30 will tend to expand and increase its radius into a flattened shape (a phenomenon referred to as "cording") to a much greater degree than the forward hook 20. This causes gaps "G1" and "G2" to be formed at the interfaces 42 and 44, respectively. These gaps can permit excessive leakage and lower the available BFM, possibly even to the point at which hot gas is ingested into the non-flow path region. Furthermore, at hot operating conditions, the shroud forward hook 20 must expand to allow for thermal deflections. This introduces stress into the forward mounting flange 30, overhang 34, and the hot surfaces of the shroud segment 12. This stress leads to lower life and increased risk of cyclic fatigue failures.

Figure 4:
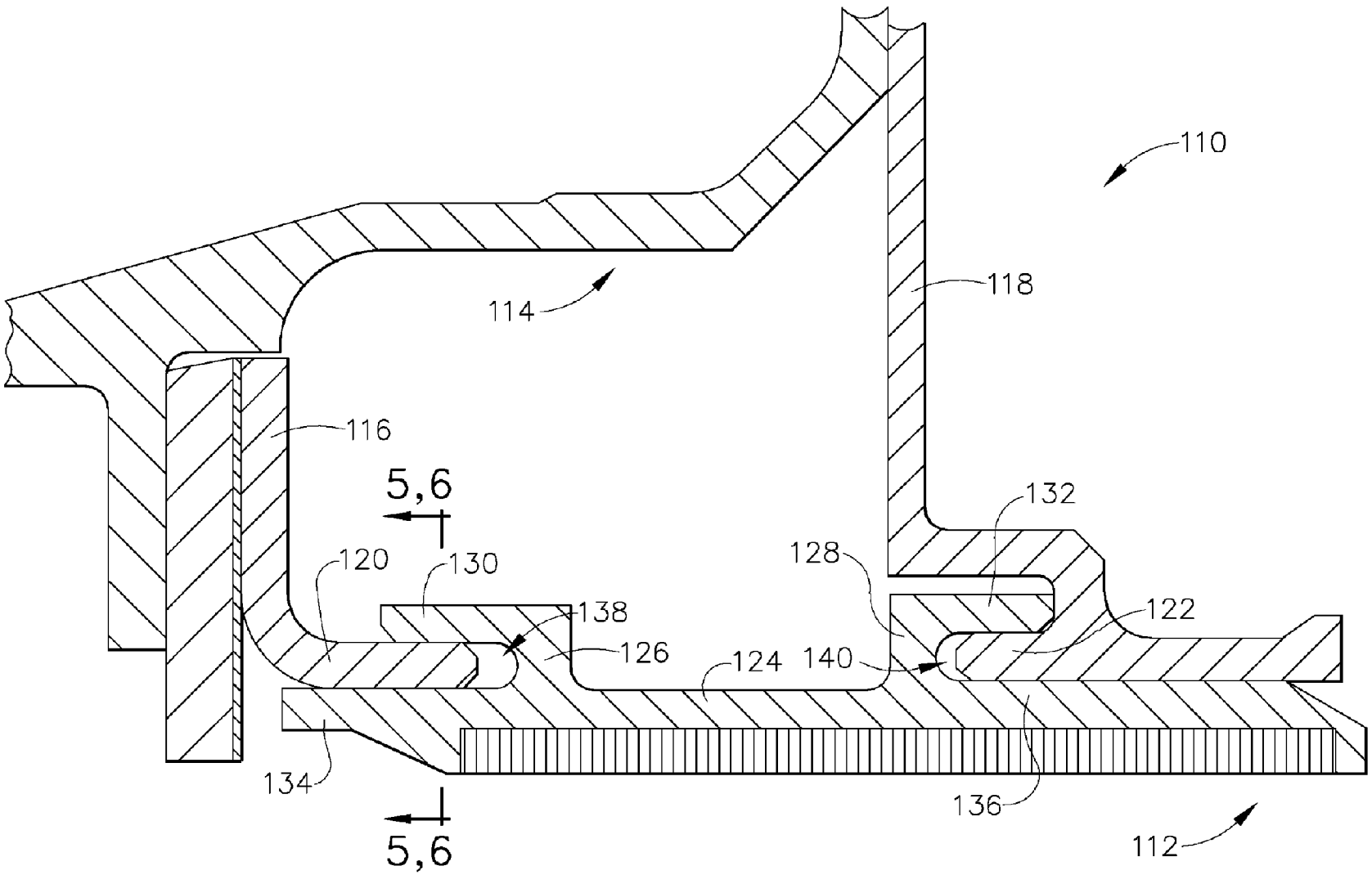
FIG. 4 is a cross-sectional view of a shroud assembly constructed according to the present invention.

FIG. 4 illustrates a shroud assembly 110 constructed according to the present invention. The shroud assembly 110 is substantially identical in most aspects to the prior art shroud assembly 10 and includes a support structure 114 with spaced-apart forward and aft radially-extending arms 116 and 118, respectively, and arcuate forward and aft hooks 120 and 122. The shroud segment 112 includes an arcuate base 124 with forward and aft rails 126 and 128, carrying forward and aft mounting flanges 130 and 132, respectively. The shroud segment 112 also has forward and aft overhangs 134 and 136 which cooperate with the forward and aft mounting flanges 130 and 132 to define forward and aft grooves 138 and 140, respectively. The forward mounting flange 130 engages the forward hook 120, and the aft mounting flange 132 engages the aft hook 122.

The shroud assembly 110 differs from the shroud assembly 10 primarily in the selection of certain dimensions of the shroud segment 112, which affects the interfaces 142 and 144 (see FIGS. 5A and 5B) between these components. In contrast to prior art practice in which the component curvatures are selected to produce matching interfaces under cold assembly conditions, the shroud segment 112 incorporates a certain amount of deviation or "correction" into the curvature.

Figure 5A:
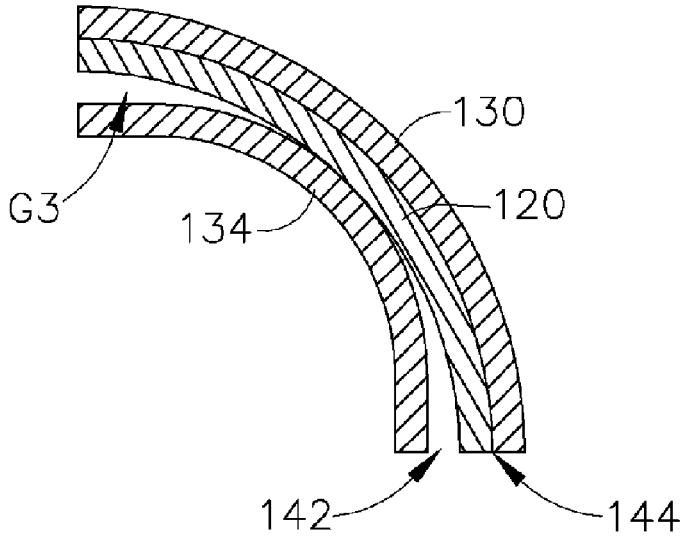
FIG. 5A is partial cross-sectional view taken along lines 5-5 of FIG. 4 at a cold assembly condition.

FIG. 5A shows the relationship of the curvatures of these interfaces 142 and 144 at a cold (i.e. ambient environmental temperature) assembly condition, also referred to as their "cold curvatures". The "hot" curvatures of the interfaces are selected to achieve a preselected dimensional relationship at the anticipated hot engine operating condition. Specifically, one of the interfaces 142 or 144 is formed to match at the cold assembly condition, while the other interface is formed to match at the hot cycle condition, with the intent of providing space for the shroud segment 112 to bend yet maintaining assembly contact at all operating conditions.

In the example shown in FIG. 5A, the curvature of the outer surface of the shroud forward overhang 134 is greater than the curvature of the forward hook 120 at the cold condition. A gap "G3" is disposed at the interface 142. The curvatures of the forward hook 120 and the forward mounting flange 130 are substantially the same such that the interface 144 is a "matched" interface.

At operating temperatures, for example bulk material temperatures of about 538° C. (1000° F.) to about 982° C. (1800° F.), the shroud segment 112, its forward mounting flange 130, and the forward overhang 134 will be hotter and expand more than the forward hook 120, causing the gap "G3" to close together and a gap "G4" to open at the interface 144 (see FIG. 5B).

Figure 6A:
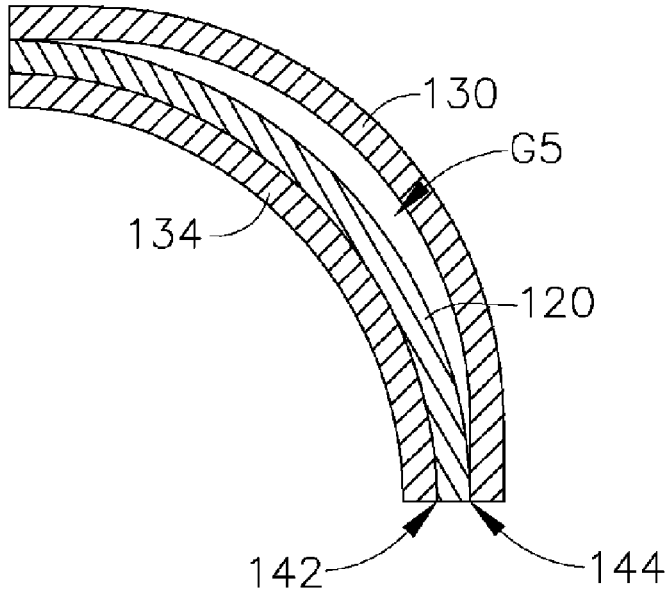
FIG. 6A is a partial cross-sectional view taken along lines 6-6 of FIG. 4, showing an alternative embodiment of the invention at a cold assembly condition.

In the example shown in FIG. 6A, the curvature of the forward mounting flange 130 is greater than the curvature of the forward hook 120 at the cold condition. A gap "G5" is disposed at the interface 144. The curvatures of the forward hook 120 and the shroud overhang 134 are substantially the same such that the interface 142 is a "matched" interface.

At operating temperatures, for example bulk material temperatures of about 538° C. (1000° F.) to about 982° C. (1800° F.), the shroud segment 112, its forward mounting flange 130, and the forward overhang 134 will be hotter and expand more than the forward hook 120, causing the gap "G5" to close together and a gap "G6" to open at the interface 142 (see FIG. 6B).

In each of the examples described above, interfaces 142 and 144 alternate contact at hot and cold conditions, reducing or eliminating bending stress and cooling flow leakage while holding the shroud segment 112 in position. The system reduces or eliminates the thermally induced stress on the assembly. It should be noted that, while the present invention has been described only with respect to the forward end of the shroud assembly 110, the same principles of curvature "correction" may be applied solely to the aft mounting flange 132, aft hook 122, and aft overhang 136 of the shroud segment 112, or they may be applied to both the forward and aft ends of the shroud segment 112.

To calculate the desired correction, a suitable means of modeling the high-temperature behavior of the shroud assembly 110 is used to simulate the dimensional changes in the components as they heat to the hot operating condition. The cold dimensions of the components are then set so that the appropriate "stack-up" or dimensional interrelationships will be obtained at the hot operating condition.

Figure 5B:
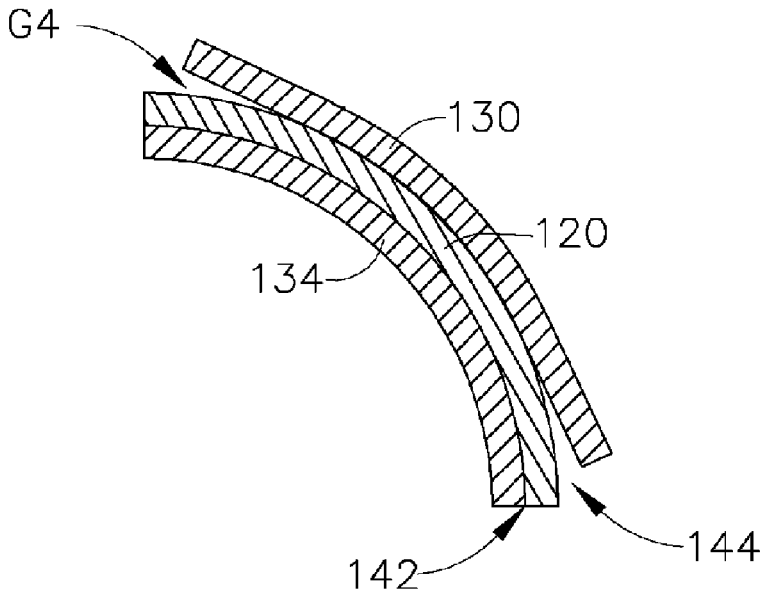
FIG. 5B is partial cross-sectional view taken along lines 5-5 of FIG. 4 at a hot operating condition.
Figure 6B:
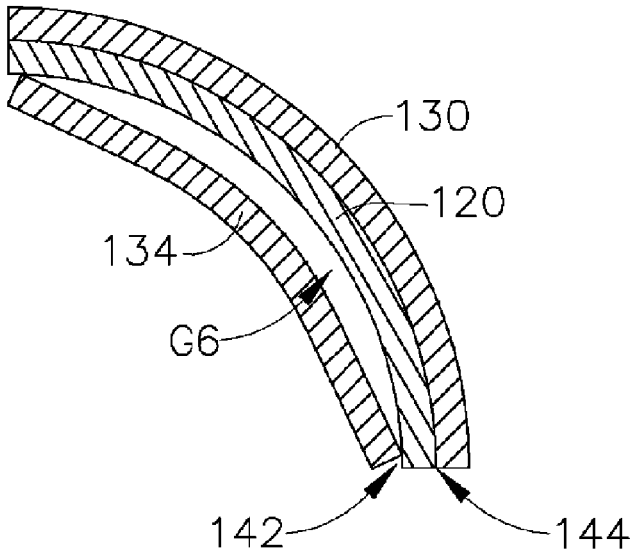
FIG. 6B is a partial cross-sectional view taken along lines 6-6 of FIG. 4 at a hot operating condition.

The amount of correction will vary with the particular application. To completely eliminate the effects of thermal expansion, a change on the order of 2 or 3 inches in the radius of the selected component might be required. This would theoretically allow either the interface 142 or the interface 144 to match at the hot operating condition. This result is what is depicted in FIGS. 5B and 6B.

In actual practice, a balance must be struck between obtaining the preselected dimensional relationship to the desired degree at the hot operating condition, and managing the difficulty in assembly caused by component mismatch at the cold assembly condition. The component stresses must also be kept within acceptable limits at the cold assembly condition. In the illustrated example, the change in radius or "correction" of the shroud forward mounting flange 130 or overhang 134 may be about 1.02 mm (0.030 in.) to about 1.27 mm (0.050 in.), This amount of correction may not completely eliminate the gaps described above, but will minimize the gap size throughout the operating temperature range and therefore minimize leakage.

While the "correction" described above has been described in terms of modifying the overall curvature of various components, it should be noted that it is also possible to achieve a desired dimensional relationship by varying the thickness of one or more of the components, which has the effect of modifying their curvature at the relevant interface. For example, the forward shroud overhang 134 may be machined so that its outside radius is smaller than its inside radius, resulting in a tapered shape with a thickness that is maximum at the center and tapers down near distal ends.

Figure 7:
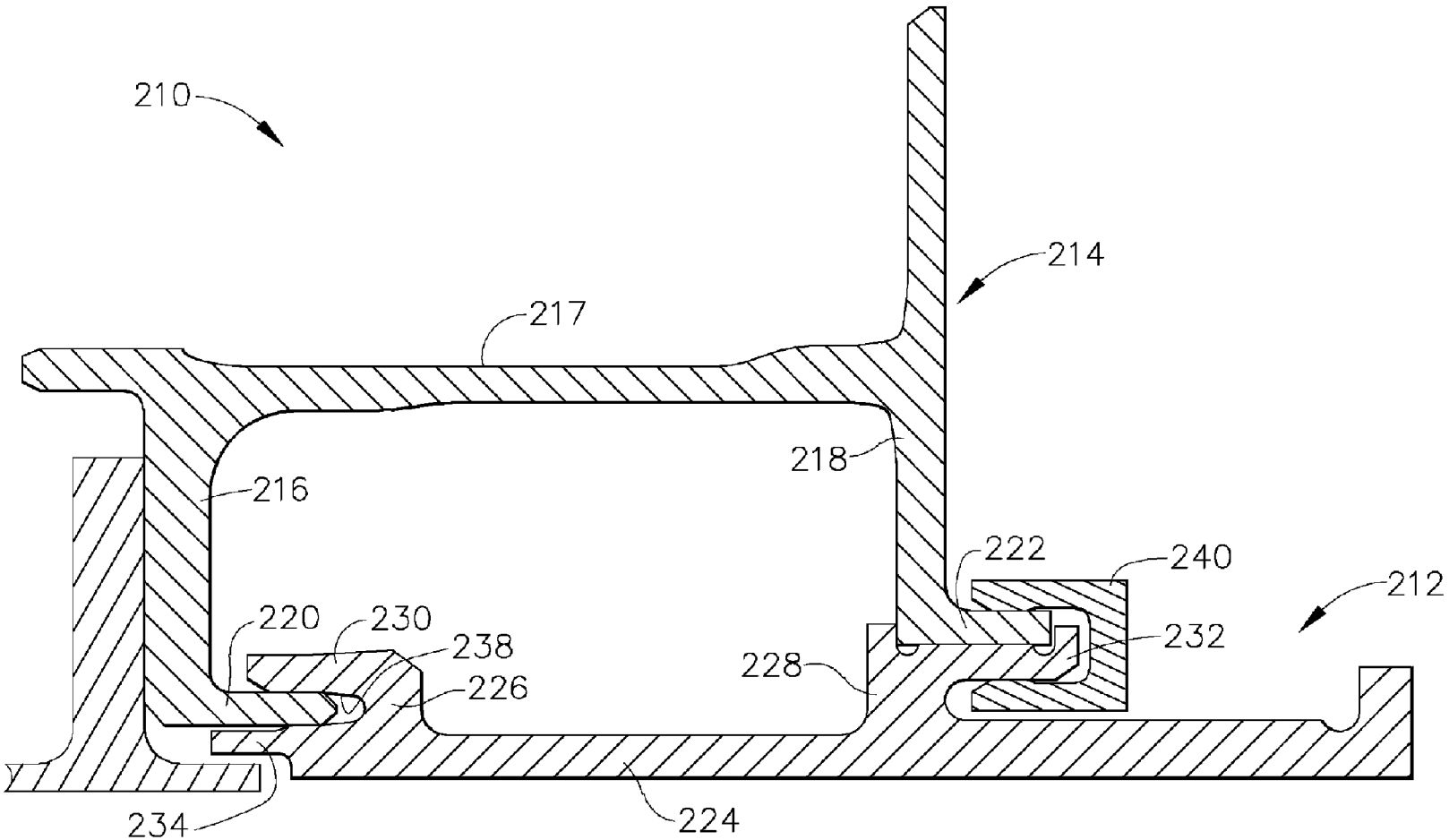
FIG. 7 is a cross-sectional view of an alternative shroud assembly.

FIG. 7 illustrates an alternative shroud assembly 210 having a generally arcuate shroud hanger 214 with spaced-apart forward and aft radially-extending arms 216 and 218, respectively, connected by a longitudinal member 217. An arcuate forward hook 220 extends axially aft from the forward arm 216, and an arcuate aft hook 222 extends axially aft from the aft arm 218.

Each shroud segment 212 includes an arcuate base 224 having radially outwardly extending forward and aft rails 226 and 228, respectively. A forward mounting flange 230 extends forwardly from the forward rail 226 of each shroud segment 212, and an aft mounting flange 232 extends rearwardly from the aft rail 228 of each shroud segment 212. An axially extending forward overhang 234 is parallel to the forward mounting flange 230 and cooperates therewith to form a forward groove 238. The forward mounting flange 230 engages the forward hook 220 of the shroud hanger 214. The aft mounting flange 232 of each shroud segment 212 is juxtaposed with the aft hook 222 of the shroud hanger 214 and can be held in place by a plurality of retaining members commonly referred to as "C-clips " 240.

The changes in curvature mentioned above with respect to the forward mounting flange 130 and forward overhang 134 can be applied to the forward mounting flange 230 or forward overhang 234 of the shroud segment 212, or both, in order to reduce leakage between the shroud hanger 214 the shroud segment 212.

The above-described configuration can result in a substantial reduction in trailing edge hook leakage flow, improving shroud BFM. The space between interfaces also significantly reduces or eliminates bending stress in the shroud segment 112 and shroud hanger 134, minimizing distortion and durability risk at the hot engine operating condition. This may provide an opportunity to reduce the number of shroud segments 112, which is generally considered beneficial for its own sake, and also reduces the number of joints between adjacent shroud segments 112 and the attendant leakage potential.

The foregoing has described a shroud assembly for a gas turbine engine. While specific embodiments of the present invention have been described, it will be apparent to those skilled in the art that various modifications thereto can be made without departing from the spirit and scope of the invention. For example, while the present invention is described above in detail with respect to a second stage shroud assembly, a similar structure could be incorporated into other parts of the turbine. Accordingly, the foregoing description of the preferred embodiment of the invention and the best mode for practicing the invention are provided for the purpose of illustration only and not for the purpose of limitation, the invention being defined by the claims.

What is claimed is:

1. A shroud assembly for a gas turbine engine having a temperature at a hot operating condition substantially greater than at a cold assembly condition, said shroud assembly comprising:

a supporting structure having an arcuate, axially-extending first hook with a first radius of curvature at a cold assembly condition;

at least one arcuate shroud segment adapted to surround a row of rotating turbine blades, said shroud segment including:

an arcuate, axially extending first mounting flange having a second radius of curvature at a cold assembly condition; and an arcuate, axially extending first overhang having a third radius of curvature at a cold assembly condition, said overhang disposed parallel to and radially inboard of said first mounting flange so that said first mounting flange and said first overhang define a first groove therebetween for receiving said first hook;

a first interface disposed between said first overhang and said first hook;

a second interface disposed between said first mounting flange and said first hook;

wherein a selected one of said second and third radii of curvature is substantially different from both the other one of said second and third radii of curvature and said first radius of curvature, such that a first gap is positioned at one of said first and second interface and said shroud hanger is subject to thermal expansion at the hot operating condition so that said shroud assembly expands circumferentially, thereby reducing the first gap.

2. The shroud assembly of claim 1 wherein said second radius of curvature is substantially less than said first and third radii of curvature.

3. The shroud assembly of claim 1 wherein said third radius of curvature is substantially less than said second and first radii of curvature.

4. The shroud assembly of claim 1 further comprising:

an axially-extending second hook carried by said supporting structure, said second hook having a fourth radius of curvature;

an arcuate, axially extending second mounting flange disposed in axially spaced-apart relationship to said first mounting flange and having a fifth radius of curvature;

an arcuate, axially extending second overhang disposed in axially spaced-apart relationship to said first overhang and having a sixth radius of curvature, said second overhang disposed parallel to and radially inboard of said second mounting flange so that a second groove is defined between said second mounting flange and said second overhang for receiving said second hook;

wherein a selected one of said fifth and sixth radii of curvature is substantially different from both the other of said fifth and sixth radii of curvature, and said fourth radius of curvature.

5. The shroud segment of claim 4 wherein said sixth radius of curvature is substantially less than said fifth radius of curvature.

6. The shroud segment of claim 4 wherein:

said fifth radius of curvature is substantially less than said sixth radius of curvature.

7. The shroud assembly of claim 1 wherein a second gap is present at the other of said interfaces at said hot operating condition, said second gap decreasing at said cold assembly condition.

8. The shroud assembly of claim 7 wherein one of said first and second gaps is substantially eliminated at said cold assembly condition, and the other of said gaps is substantially eliminated at said hot operating condition.

* * * * *